United States Patent [19]

Johnson

[11] 4,100,632

[45] Jul. 18, 1978

[54] BEDDING

[76] Inventor: Anna M. Johnson, 37331 Park Ave., Willoughby, Ohio 44094

[21] Appl. No.: 718,837

[22] Filed: Aug. 30, 1976

[51] Int. Cl.[2] ..... A47G 9/04

[52] U.S. Cl. ..... 5/334 R

[58] Field of Search ..... 5/305, 327, 334

[56] References Cited

U.S. PATENT DOCUMENTS

| | | | |
|---|---|---|---|
| 2,096,913 | 10/1937 | Munro | 5/334 R |
| 2,202,582 | 5/1940 | Higginbotham | 5/334 R |
| 2,769,184 | 11/1956 | Collica | 5/327 R |
| 2,979,737 | 4/1961 | Pierre | 5/334 R |
| 3,284,816 | 11/1966 | Laubsch | 5/334 R |

*Primary Examiner*—Kenneth Downey

[57] ABSTRACT

Bedding and the means for securing it for use with a bed with headboard and footboard so that the mattress never need be lifted to make the bed or to strip it. The bottom sheet is the size of the top of the mattress, with a hem at the headboard end and a hem at the footboard end to accommodate a rod. The rod, with a protruding external wedge at each end, fits into one of several slots in an adjusting plate mounted at each outer edge of the headboard and footboard members at the area of the mattress, with the wedges on the rod fitting into corresponding notches in the slots in the adjusting plate to hold the sheet under tension. A similar rod with similar wedges is accommodated in a hem at the footboard end of the top sheet and a similar rod with similar wedges is accommodated in a hem at the footboard end of other bedclothing and fitted securely in other slots and notches in the adjusting plates mounted at the outer edges of the footboard member to hold the main body of these bedding items in place on top of the mattress.

1 Claim, 5 Drawing Figures

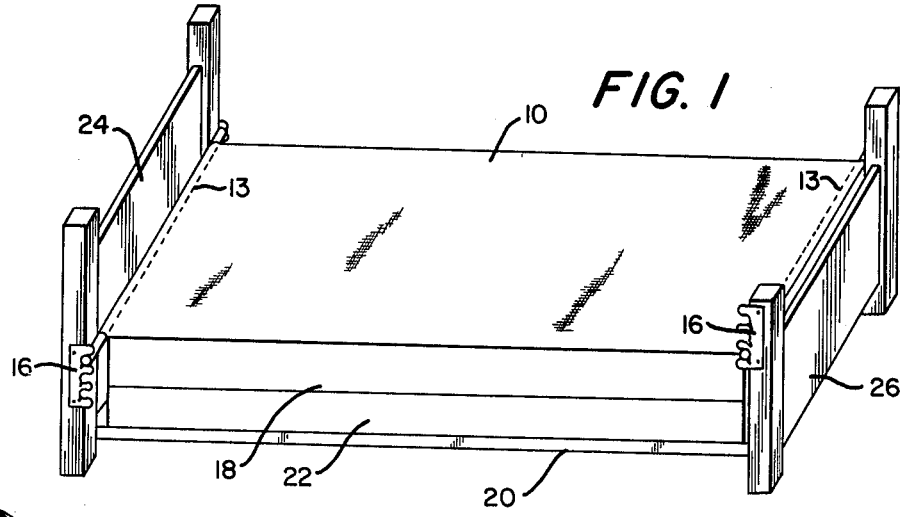
FIG. 1
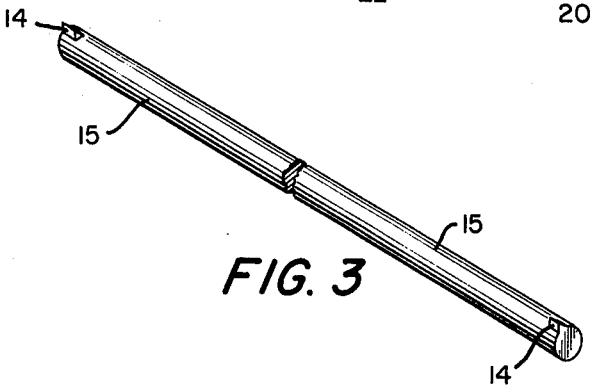
FIG. 3
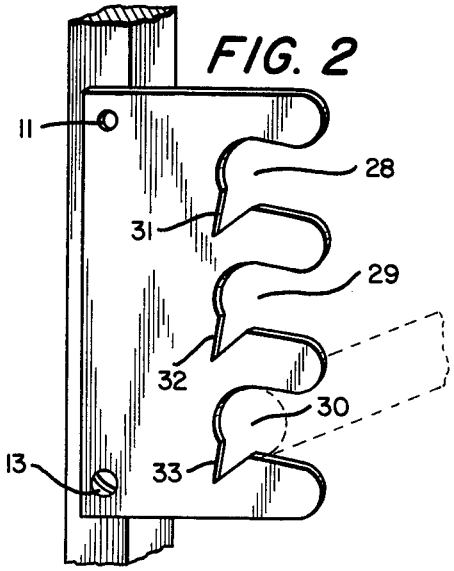
FIG. 2
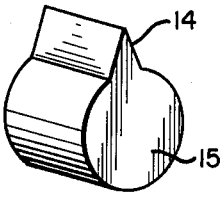
FIG. 4
FIG. 5
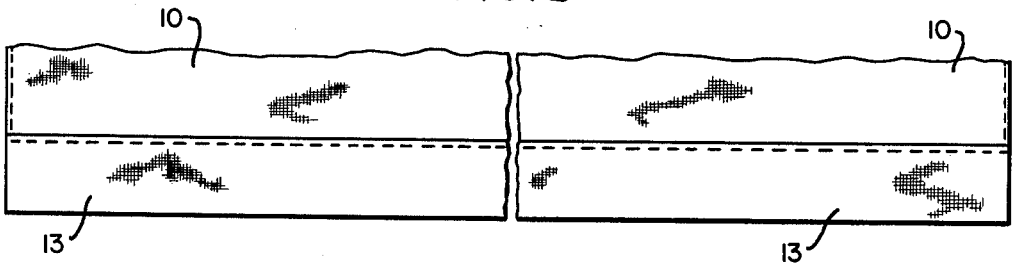

BEDDING

This invention is directed toward bedding that fits on top of the mattress and with means for securing it to a bed with headboard and footboard to minimize the labor of making a bed.

This is accomplished by using a bottom sheet which is of a size to fit the top of the mattress. A hem at the headboard end and a hem at the footboard end of the sheet accommodate a rod which is fitted into one of several slots in an adjusting plate mounted at each outer edge of the headboard and footboard members at the area of the mattress. A protruding external wedge on each end of the rod fits into a corresponding notch in the slot to hold the rod securely in the adjusting plate. The various slots in the adjusting plates mounted on the outer edge of the headboard member are to provide for variation in length of the bottom sheet by placement of the rod in the slot which provides the right tension on the sheet to keep it tight.

The lowest rod-accommodating slot in the adjusting plates at the footboard end is used to hold the rod located in the hem of the bottom sheet. The other rod-accommodating slots in the adjusting plates mounted at the footboard member are to hold rods accommodated in the bottom end of the top sheet with a similar hem and in the bottom end of other bedclothing with a similar hem, with the wedges on these rods fitting into corresponding notches in the slots in the adjusting plates mounted at each outer edge of the footboard member at the area of the mattress, so that the mattress never needs to be lifted to make the bed or to remove soiled bedding.

In the drawings,

FIG. 1 is a view of a bed illustrating the invention in use;

FIG. 2 is an enlarged side elevational view of one of the adjusting plates and showing in phantom a rod in one of the slots with its wedge fitted in the notch to hold the rod in place;

FIG. 3 is a broken plan view of one of the rods;

FIG. 4 is a detail end elevational view of the rod with its wedge showing;

FIG. 5 is a broken plan view of an article of bedclothing having the hem thereon according to this invention.

Referring more specifically to the drawings, FIG. 1 illustrates a conventional bed having thereon a mattress 18 and springs 22 on frame 20. Sheet 10 covers the top of the mattress area. Hem 13 shows as a dotted line parallel to the headboard and footboard of the bed. Headboard 24 and footboard 26 have the adjusting plates 16 mounted at each outer edge, with the top slot in the adjusting plate at the headboard end at the area of the top of the mattress, and the bottom slot in the adjusting plate at the footboard end at the area of the top of the mattress. The inventor would like to suggest that the bottom sheet be secured at the bottom end first, so that the best slot to put the rod in at the headboard end to keep the sheet taut could be easily determined.

FIG. 2 shows the adjusting plate of substantially flat construction mounted vertically at the outer edge of a section of the headboard or footboard member, with the slots and notches being parallel to the side of the mattress. The vertical base portion of the adjusting plate is provided with a pair of mounted openings 11 adapted to be aligned with a corresponding pair of openings provided in each outer edge of the headboard and footboard and secured thereto by means of screws 13. The adjusting plate has three slots 28, 29, and 30, with notches 31, 32, and 33 which hold the wedges securely. A phantom rod is shown with its wedge fitting into one of the notches in the adjusting plate. FIG. 3 shows a broken view of the rod 15 with the wedge 14 in a view from the top at left and a view from the side at the right. The rod can be made of metal, plastic wood, or other suitable material. FIG. 4 shows the rod from the end, with the wedge in view. FIG. 5 shows the hem 13 in the end of the sheet 10 parallel to the headboard or footboard. The inventor is showing a flat surface for the adjusting plate to be mounted on. Rounded headboard and footboard members would require a slightly different shaped adjusting plate.

While the invention has been described with detailed reference to the drawings, the protection sought is to be limited only by the terms of the claims which follow.

I claim:

1. In combination with a mattress supported on a frame having a headboard and a footboard, a bottom sheet comprising a flat rectangular panel of a size to cover the top of said mattress, means securing the ends of the bottom sheet to the headboard and footboard comprising a hem provided at each end of the bottom sheet, rods positioned in said hems with said rods having ends extending outwardly beyond the edges of said bottom sheet and having wedge-like projections on said extending ends, first spaced brackets secured to said headboard adjacent the top corner of said mattress and at a lower level than second spaced brackets secured to said footboard adjacent the bottom corner of said mattress, each of said brackets being provided with a plurality of vertically spaced notches adapted to receive said wedge-like projections on the ends of said rods, a top sheet and other bedclothing having hems at the foot ends thereof accommodating similar rods, whereby the bottom sheet is secured to appropriate notches in the brackets secured to the footboard and headboard to hold said bottom sheet under tension and the top sheet and other bedclothes are secured at their foot ends in others of said vertically spaced notches in the brackets secured to the footboard.

* * * * *